US006685878B1

(12) United States Patent
Overländer et al.

(10) Patent No.: US 6,685,878 B1
(45) Date of Patent: Feb. 3, 2004

(54) THROAT CLOSING DEVICE FOR SHAFT FURNACES, ESPECIALLY BLAST FURNACES HAVING A MATERIAL FEEDING HOPPER

(75) Inventors: Jörg Overländer, Oberhausen (DE); Elmar Korbik, Essen (DE); Heinz-Peter Marciniak, Dinslaken (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/980,914

(22) PCT Filed: Apr. 26, 2000

(86) PCT No.: PCT/EP00/03722

§ 371 (c)(1),
(2), (4) Date: Apr. 10, 2002

(87) PCT Pub. No.: WO00/66794

PCT Pub. Date: Nov. 9, 2000

(30) Foreign Application Priority Data

Mar. 5, 1999 (DE) ..... 199 20 002

(51) Int. Cl.[7] ..... C21B 7/20
(52) U.S. Cl. ..... 266/184; 266/199
(58) Field of Search ..... 266/184, 199

(56) References Cited

U.S. PATENT DOCUMENTS 5,938,432 A * 8/1999 Heinrich et al. ..... 266/184

FOREIGN PATENT DOCUMENTS

| | | |
|---|---|---|
| EP | 0433201 | 6/1991 |
| GB | 258631 | 9/1926 |

OTHER PUBLICATIONS

Database WPI, Section CH, Week 198619, AN 1986–122765 & JP 61062782 A (Nippon Steel Corp), Mar. 31, 1986.

Patent Abstracts of Japan, vol. 006, No. 227 (C–134), Nov. 12, 1982 & JP 57 1312311 A (Sumitomo Junikai Kogyo KK) Aug. 14, 1982.

* cited by examiner

*Primary Examiner*—Melvyn Andrews
(74) *Attorney, Agent, or Firm*—Friedrich Kueffner

(57) ABSTRACT

The invention relates to a throat closing device for shaft furnaces, especially blast furnaces having a material feeding hopper (1), to which a temporarily rotating rotary hopper (2) which is sealed with regard to the stationary parts (3) is connected. The inventive throat closing device is produced such that it has a less complex construction and is easier to install, and can be easily serviced due to the provision of a sealing unit (5) comprised of an adjusting flange (7) which is arranged above the rotary hopper (2), is complementary to the hopper flange (6) thereof, can be lifted and lowered, and which comprises seals (8, 9) located on the flange underside. Said sealing unit is configured in a spanning wall (12) which comprises a compensating element (13) and which connects the adjusting flange (7) to the stationary part (3) of the rotary hopper (2).

5 Claims, 2 Drawing Sheets

THROAT CLOSING DEVICE FOR SHAFT FURNACES, ESPECIALLY BLAST FURNACES HAVING A MATERIAL FEEDING HOPPER

BACKGROUND OF THE INVENTION

1. Field of the Invention

The invention relates to a throat closing device for shaft furnaces, in particular, blast furnaces with a material feeding hopper to which is connected a temporarily rotating rotary hopper sealed relative to the stationary parts.

2. Description of the Related Art

For filling in and distributing charges for burdening shaft furnaces, devices have been known for a long time which are configured according to the so-called McKee principle. In this configuration—a bell-type throat closing device—in the upper part a "small bell" and in the lower part a "large bell" are arranged. In this connection, the upper one of the stacked bells or hoppers is rotatable.

A further development of the McKee-type throat closing device resides in that the lower large bell must not form a gas-tight closure because the rotary distributing hopper closed by the bell is arranged in a seal-tight enclosure.

In an arrangement known from DE 36 32 724 C2 the problem of providing a seal between the lower distributing bell and the lower lock chamber is solved in that the upper hopper is formed as a pressure-tight closeable lock chamber by means of a stationary hood provided with burdening flaps.

From DE-AS 10 13 681 a sealing device on rotatable throat closing devices of blast furnaces is known, comprising a pressure ring fastened on the rotary hopper and a matching stationary annular sealing mass, wherein the sealing action of the pressure ring and sealing mass is realized by a spring force. In an annular housing, which is fastened in a gas-tight way on the throat hood, adjustable springs are arranged for this purpose which continuously press the sealing mass onto the sliding ring rotating with the rotary hopper. The pressing force of the springs can be variably adjusted by a clamping device comprised of a readjustable clamping screw.

In further known burdening devices for blast furnaces, for example, according to DE 20 35 458, DE 20 65 460, which are operated at the throat with counterpressure, a stationary central material inlet is provided via which the burden falls onto a rotary chute. The rotary support and the drive parts of the chute are located in the furnace space. This latter described feeding device has also been improved in many ways. For example, the rotary support and the drive parts of the chute have been arranged in their own housing which is separate from the remaining furnace space. A flushing gas inlet opens into the aforementioned housing. This is designed to prevent that hot and dust-laden blast furnace gases can enter.

For supplying material in order to operate a shaft furnace, different types of burdening devices are known. For example, a rotary hopper which is driven by a crown gear is used in a bell-type closure for uniform material distribution. The inner space of the rotating hopper is located in the direct surroundings of the furnace space, i.e., the space is exposed to the furnace atmosphere. For this reason, sealing of the rotating part of the hopper relative to the surroundings is necessary. The sealing action is realized by means of a labyrinth seal by using spring-loaded graphite rings, preferably composed of segments connected by tongue and groove connections which provide sealing in an $N_2$ atmosphere. The $N_2$ atmosphere must be regulated relative to the furnace pressure so that a slight overpressure relative to the furnace pressure is present. Nitrogen is moreover a gas which is very expensive.

SUMMARY OF THE INVENTION

It is an object of the invention to provide a throat closing device of this kind without the aforementioned disadvantages, wherein, at the same time, it should be of a constructively simpler configuration and more assembly-friendly as well as have good servicing possibilities.

This object is solved according to the invention by a sealing unit comprised of a liftable and lowerable adjustable flange arranged above the rotary hopper and complementary to its hopper flange and having seals at the flange underside and being provided with a compensation element on the bridging wall connecting the adjusting flange with the stationary part of the rotary hopper. The compensation element, advantageously, for example, in the form of a loop-like strip configuration or the like, can be configured such that, for example, an axial movement of approximately 50 mm, a lateral movement of approximately 20 mm, as well as an overpressure of 3.5 bar can be received. The system can be controlled such that during the material supply from the receiving hopper into the space "small bell" the adjusting flange is lifted. Subsequent to supplying the material, the rotary hopper can rotate for the purpose of material distribution. Before emptying the space "small bell" into the space "large bell", the adjusting flange is lowered so that the parts are sealed relative to one another; this makes it possible to perform a required pressure compensation. The deformable compensation element which makes possible the movement play is moreover able to compensate a possible displacement relative to the axis of rotation. Moreover, a nitrogen atmosphere is not needed in order to generate a slight overpressure relative to the furnace pressure. The entire sealing unit or the sealing system is easily accessible from the exterior and, moreover, enables assembly on site.

According to a preferred embodiment of the invention, lifting cylinders connected to the adjusting flange are arranged in a distributed fashion on the periphery of the stationary part of the rotary hopper and attached thereto. These hydraulic cylinders take over not only lifting and lowering and thus venting of the adjusting flange during feeding of the material, but can also provide a securing force which must only be so great that lifting off of the sealing unit as a result of the force of the inner pressure of the shaft furnace is prevented.

According to a suggestion of the invention the adjusting flange has two spaced apart annular seals of which the forward annular seal neighboring the axis of rotation of the rotary hopper is formed as a seal preventing dust from exiting when the adjusting flange is lifted. During material supply the outer annular seal, which is moved toward the end face of the adjusting flange, is not active in the lifted position of the adjusting flange, i.e., it is not in an engaged position. On the other hand, the forward annular seal closer to the axis of rotation prevents even in the vented operating position of the adjusting flange the dust from exiting. Before emptying the space "small bell" into the space "large bell", the cylinders are moved so that a sealing action of the parts for performing the required pressure compensation takes place. During the course of lowering of the adjusting flange approaching increasingly the hopper flange, the dust particles lying on the counter surfaces are engaged by the annular seal via the sealing edges of the annular seal and moved so that a substantially dust-free sealing surface results.

One embodiment of the invention suggests that between the rotary hopper flange and the adjusting flange a stop is arranged. This stop which is fastened, preferably adjustably, on the rotary hopper flange prevents impermissible pressing of the seals. The adjustability makes it possible to compensate a possible seal wear.

According to the invention it is furthermore suggested to provide a gliding skirt upstream of the compensation element relative to the furnace or hopper interior which skirt is secured with only one end on the bridging wall and rests with the other end loosely on the bridging wall. Accordingly, a skirt is thus provided at the compensation element which provides reinforcement in the direction toward the pressure area and which, as a result of its loose arrangement on one side, can glide with its free end across the bridging wall upon lifting movements of the adjusting flange.

BRIEF DESCRIPTION OF THE DRAWINGS

Further features and advantages of the invention result from the claims and the subsequent description with the aid of an embodiment of the invention illustrated in the Figures. It is shown in:

DETAILED DESCRIPTION OF THE PREFERRED EMBODIMENTS

Figure 1:
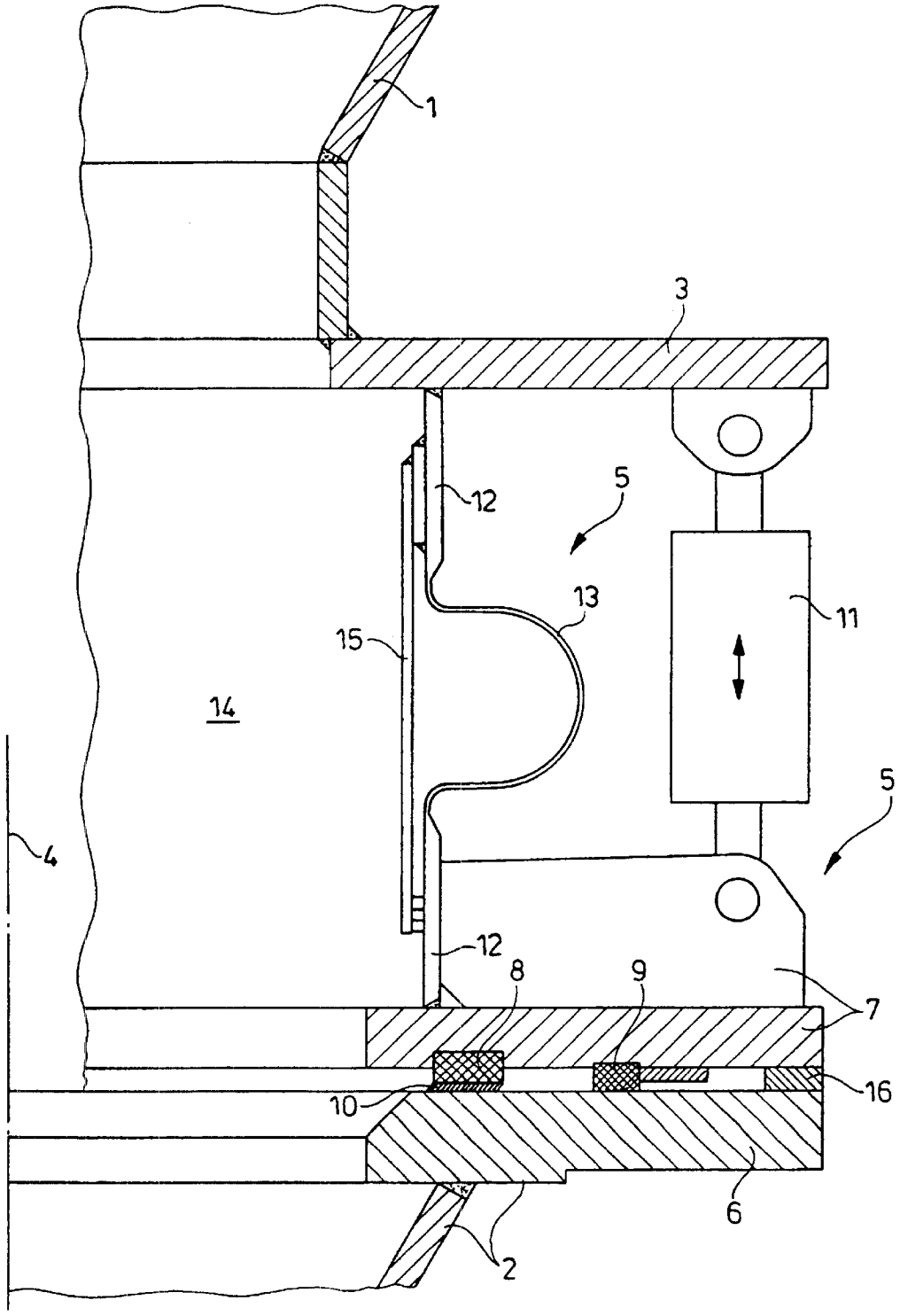
FIG. 1 as a detail a schematic partial view of a sealing unit of a shaft furnace, not illustrated in detail, with loading by furnace pressure.

FIG. 1 shows of the entire symmetrical device arrangement of a shaft furnace, which is known in the art as such, as one symmetric half in a very schematic way only a material feeding hopper 1 with a rotary hopper 2 ("small bell") arranged underneath, wherein between the rotary hopper 2 and the material feeding hopper 1 a stationary part 3 is provided. Drive means, not illustrated, are correlated with the rotary hopper 2 for rotation about the axis of rotation 4.

In the free space between the rotary hopper 2 and the stationary supporting part 3 a sealing unit 5 is arranged. It comprises, on the one hand, a liftable and lowerable adjustable flange 7 arranged above the rotary hopper flange 6 and being complementary thereto, which has at its underside two concentric annular seals 8, 9 arranged at a spacing to one another, of which the annular seal 8 closer to the axis of rotation is formed as a dust seal provided with bristles 10 facing the rotary hopper flange 6. About the periphery of the stationary part 3 of the rotary hopper 4 several lifting cylinders 11 are distributed and fastened and connected at their other end with the adjusting flange 7. On the other hand, a loop-shaped compensation element 13 is provided within a cylinder mantle-shaped bridging wall 12 connecting the adjusting flange 7 with the stationary part 3. A gliding skirt 15 is arranged in front of the compensation element 13 toward the furnace or hopper interior 14 and, at its upper end facing the stationary part 3, is secured to the bridging wall 12 while its opposite end is freely movable and, upon adjusting movements of the lifting cylinder 11, glides in the direction of the double arrow on the corresponding parts of the lower part of the bridging wall 12.

FIG. 1 shows the operating phase before emptying of the material supplied to the rotary hopper 2 in which the lifting cylinders 11 have lowered the adjusting flange 7 such that a sealing action of the parts relative to one another takes place in order to be able to perform the required pressure compensation. The end position of the advancing movement is defined by an adjustable and exchangeable stop 16 which prevents at the same time an impermissible pressing of the annular seals 8 and 9. In the illustrated lowered position of the adjusting flange 7 the sealing edges of the rearward annular seal 9 rest tightly against the counter surface of the rotary hopper flange 6, wherein dust particles present on the counter surface are engaged by the sealing edge and are moved upon lowering of the adjusting flange 7. The same effect is realized upon deformation of the bristles 10 of the annular seal 8 that is closer to the axis of rotation.

Figure 2:
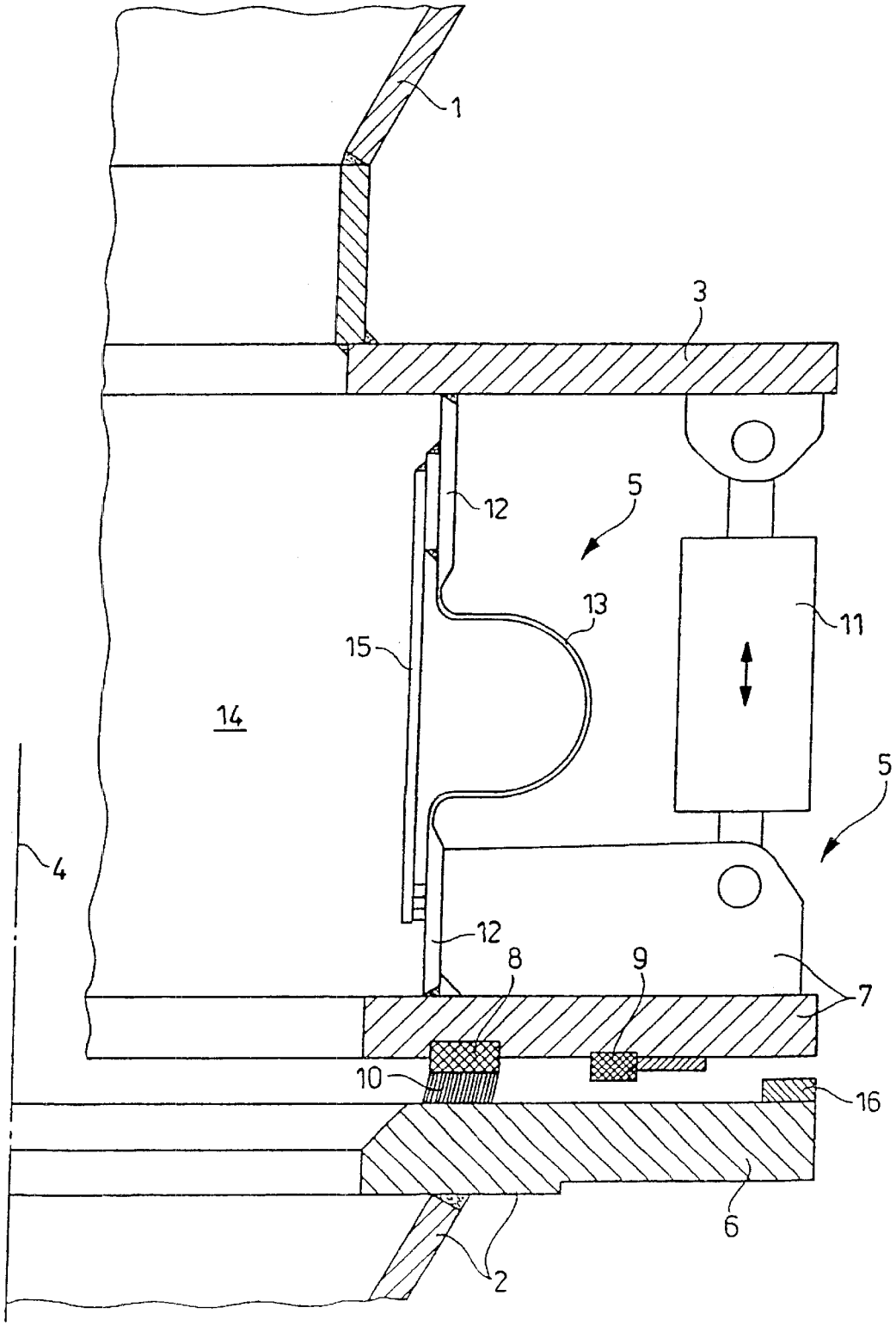
FIG. 2 in a representation corresponding to the sectioned partial view according to FIG. 1, wherein the sealing system is vented in contrast to loading with the material, with loading by surrounding pressure.

For material supply and distribution from the receiving or inlet hopper 1 into the rotary hopper 2 ("small bell"), with only the surrounding pressure now being present, the adjusting flange 7 supporting the seals 8, 9 is lifted by the lifting cylinder 11 into the position illustrated in FIG. 2. The loop-shaped compensation element 13 makes possible in this connection a compensation of the movement play resulting from the cylinder adjustments. The compensation element 13 can compensate an axial movement as well as a lateral movement and can also receive a certain overpressure. The annular seal 8 closer to the rotational axis, which is resting against the counter surface of the rotary hopper flange 6 with its bristles 10 even in the vented state, prevents the dust from exiting in this rotational operating phase of the rotary hopper 2. With the sealing unit 5 including the compensation element 13 it is thus possible in a simple way to ensure a reliable sealing action despite the movement play required for the rotation of the rotary hopper, wherein the entire unit is freely accessible and is thus service-friendly and assembly-friendly.

What is claimed is:

1. A throat closing device for blast furnaces, comprising a material feeding hopper and a rotary hopper having a temporarily rotating hopper flange and a stationary part attached to the material feeding hopper, a sealing unit comprised of a liftable and lowerable adjusting flange arranged above the hopper flange and being complementary to the hopper flange, flange seals attached to an underside of the adjusting flange, a bridging wall connecting the adjusting flange with the stationary part of the rotary hopper, and a compensating element mounted in the bridging wall.

2. The throat closing device according to claim 1, wherein the stationary part of the rotary hopper has a periphery and wherein lifting cylinders, arranged about and fastened on the periphery of the stationary part of the rotary hopper, are connected to the adjusting flange.

3. The throat closing device according to claims 1, wherein the hopper flange has an axis of rotation, and wherein the adjusting flange supports two annular seals which are spaced apart from one another, wherein one of the annular seals located adjacent the axis of rotation is configured as a seal providing sealing action when the adjusting flange is lifted.

4. The throat closing device according to claim 3, comprising a stop mounted between the hopper flange and the adjusting flange for preventing compression of the annular seals.

5. The throat closing device according to claim 4, further comprising a gliding skirt arranged between the compensation element and an interior of the material feeding hopper, wherein a first end of the gliding skirt is attached to the bridging wall and a second end of the gliding skirt rests loosely against the bridging wall.

* * * * *